US008960587B2

(12) United States Patent
Akpan

(10) Patent No.: US 8,960,587 B2
(45) Date of Patent: Feb. 24, 2015

(54) REAR DISCHARGE MAT ROLLING MACHINE

(75) Inventor: Kufre Effiong Akpan, Maple Grove, MN (US)

(73) Assignee: Umana Family Corporation, Carbondale, IL (US)

( * ) Notice: Subject to any disclaimer, the term of this patent is extended or adjusted under 35 U.S.C. 154(b) by 130 days.

(21) Appl. No.: 13/480,627

(22) Filed: May 25, 2012

(65) Prior Publication Data

US 2012/0298787 A1 Nov. 29, 2012

Related U.S. Application Data

(60) Provisional application No. 61/491,001, filed on May 27, 2011, provisional application No. 61/492,984, filed on Jun. 3, 2011, provisional application No. 61/531,821, filed on Sep. 7, 2011.

(51) Int. Cl.
*B65H 18/22* (2006.01)

(52) U.S. Cl.
CPC ..... *B65H 18/22* (2013.01); *B65H 2301/4138* (2013.01); *B65H 2404/264* (2013.01); *B65H 2404/265* (2013.01); *B65H 2553/41* (2013.01); *B65H 2701/177* (2013.01); *B65H 2701/1846* (2013.01); *B65H 2701/1922* (2013.01)
USPC ..... 242/535.1; 242/535.4; 242/541.2; 242/541.3

(58) Field of Classification Search
USPC ..... 242/535.1, 535.4, 541.2–541.3
See application file for complete search history.

(56) References Cited

U.S. PATENT DOCUMENTS

| | | | |
|---|---|---|---|
| 1,951,060 | A | 3/1934 | Mudd |
| 2,573,188 | A | 10/1951 | Dyken |
| 2,893,007 | A | 7/1959 | Windt |
| 3,474,980 | A | 10/1969 | Mann, Jr. |
| 3,588,994 | A | 6/1971 | Parenti |
| 3,782,664 | A | 1/1974 | Alberto |
| 4,151,634 | A | 5/1979 | Stolz |

(Continued)

FOREIGN PATENT DOCUMENTS

| | | | |
|---|---|---|---|
| GB | 2214496 | B | 11/1991 |
| JP | 62031644 | A | 2/1987 |

(Continued)

OTHER PUBLICATIONS

"Dustmat Rolling: Rugtved MRX dustmat roller," Broadbent laundry systems division, pp. 1-2, Thomas Broadbent & Sons Ltd., Huddersfield, England.

*Primary Examiner* — Sang Kim
(74) *Attorney, Agent, or Firm* — Seager, Tufte & Wickhem LLC

(57) ABSTRACT

A mat rolling machine for rolling a mat having a leading edge and a trailing edge may include a frame, at least one first drive belt, a plurality of second drive belts, a plurality of third drive belts, and a plurality of fourth drive belts. At least one of the belts may be coupled together at an oblique angle relative to the direction of travel of the belt. The mat rolling machine may include a plurality of primary fingers and a plurality of secondary fingers having a smaller radius of curvature on a lower face than the plurality of primary fingers. The mat rolling machine may include at least one support member for guiding a mat along a path through the mat rolling machine, and at least one pusher for discharging a rolled mat from the rear of the mat rolling machine.

25 Claims, 11 Drawing Sheets

(56) References Cited

U.S. PATENT DOCUMENTS

| | | | |
|---|---|---|---|
| 4,256,269 | A | 3/1981 | Feighery et al. |
| 4,273,300 | A | 6/1981 | Wojtowicz et al. |
| 4,298,173 | A | 11/1981 | Johansson |
| 4,420,124 | A | 12/1983 | Bardsley |
| 4,542,859 | A | 9/1985 | Gerstenberger |
| 4,573,644 | A | 3/1986 | Brown |
| 4,765,554 | A | 8/1988 | Tuffal et al. |
| 4,809,921 | A | 3/1989 | Dueck et al. |
| 4,830,304 | A | 5/1989 | Fuke et al. |
| 4,973,010 | A | 11/1990 | Brown |
| 5,390,407 | A | 2/1995 | Musil |
| 5,531,012 | A | 7/1996 | Schick |
| 5,906,038 | A | 5/1999 | Herold |
| 6,027,066 | A | 2/2000 | Street |
| 6,109,560 | A | 8/2000 | Siegel |
| 6,629,662 | B2 | 10/2003 | Howden et al. |
| 8,151,432 | B2 | 4/2012 | Daniels et al. |
| 8,444,079 | B2 * | 5/2013 | Akpan ..... 242/535.1 |
| 2002/0195516 | A1 | 12/2002 | Howden et al. |
| 2006/0026802 | A1 | 2/2006 | Musil et al. |
| 2009/0145732 | A1 | 6/2009 | Maine, Jr. et al. |
| 2009/0223783 | A1 | 9/2009 | Herold |
| 2011/0180651 | A1 | 7/2011 | Akpan |
| 2011/0278136 | A1 | 11/2011 | Weiser et al. |
| 2012/0090159 | A1 | 4/2012 | Hahn |
| 2013/0240659 | A1 * | 9/2013 | Akpan ..... 242/548 |

FOREIGN PATENT DOCUMENTS

| | | | |
|---|---|---|---|
| WO | 9009946 | A1 | 9/1990 |
| WO | 2006032154 | A1 | 3/2006 |

* cited by examiner

REAR DISCHARGE MAT ROLLING MACHINE

CROSS-REFERENCE TO RELATED APPLICATIONS

This application claims priority to U.S. Provisional Application No. 61/491,001, filed May 27, 2011, and U.S. Provisional Application No. 61/492,984, filed Jun. 3, 2011, and U.S. Provisional Application No. 61/531,821, filed Sep. 7, 2011.

FIELD

The present disclosure relates generally to machinery and methods for rolling large mats, carpets, rugs, and the like.

BACKGROUND

Mat rolling machines are typically used in the field of commercial rug cleaning. Large rugs and mats of the sort typically found in the lobbies, foyers and hallways of commercial, retail and industrial enterprises are sometimes removed for off-site cleaning. Once cleaned, these rugs may be rolled on a mat rolling machine to quickly shape the rug into a generally cylindrical form for ease of delivery.

A typical prior art mat rolling machine may be seen in U.S. Pat. No. 4,573,644 and U.S. Pat. No. 4,973,010, hereby incorporated by reference. The mat rolling machines of the above-cited references have a frame and a hood housing a first set of horizontal or slightly inclined belts interleaved with a second set of generally vertical belts. The first set of belts moves the rug towards the second set of belts, which then moves the rug upward. The front edge of the rug travels upwards towards a set of fingers which curve the front edge of the rug back over to begin forming the rug into a cylindrical roll. Once the initial cylinder shape is formed, the action of the first set of belts and the second set of belts continue to roll the rug into a cylindrical shape. There is a control panel positioned generally below the first set of belts, and there are emergency stop buttons located on the hood above the fingers. These mat rolling machines can roll a rug such that the hollow interior of the roll is about 3 to 5 inches in diameter.

There is an ongoing need for an improved mat rolling machine and components thereof to roll rugs and mats.

SUMMARY

A mat rolling machine includes a frame defining a front and a rear of the machine. At least one first drive belt may feed the mat towards a plurality of second drive belts, a plurality of third drive belts, and a plurality of fourth drive belts. The mat may contact each of the belts in succession as the mat travels a path through the mat rolling machine. At least one support member may be disposed between adjacent second drive belts to guide the mat upward as the mat travels into the mat rolling machine. The mat rolling machine includes a set of primary fingers and a set of secondary fingers. The set of secondary fingers has a smaller radius than the set of primary fingers. Both sets of fingers are deployed when a mat is fed into the machine, and the set of secondary fingers forms a tight initial cylinder as the mat is rolled into a generally spiral configuration. After a predetermined period of time, the set of secondary fingers rotates up and the set of primary fingers, which have a larger radius, remains down to guide the mat as the rolled cylinder grows larger. One or more of the drive belts may be coupled together by a plurality of belt fastening means at an oblique angle relative to a direction of travel of the belt.

A method of rolling a mat includes obtaining a mat rolling machine. A mat may be disposed upon the at least one first drive belt. The belts may be activated independently, at the same time, or in any combination thereof. The mat may be fed into the mat rolling machine. The plurality of primary fingers and the plurality of secondary fingers may be actuated into a lowered mat-rolling position. The fingers may cooperate with the drive belts to initiate a roll into a generally spiral configuration. After initiating the roll, the secondary fingers may be raised out of contact with the mat, and the primary fingers may remain in the lowered mat-rolling position to maintain the roll and form the mat into the generally spiral configuration. The primary fingers may then be raised out of contact with the mat. The belts may be stopped independently, together, or in any combination thereof. After stopping the belts, at least one pusher may be actuated to discharge the rolled mat from the rear of the mat rolling machine.

BRIEF DESCRIPTION OF DRAWINGS

The invention may be more completely understood in consideration of the following detailed description of various embodiments of the invention in connection with the accompanying drawings, in which.

Figure 1:
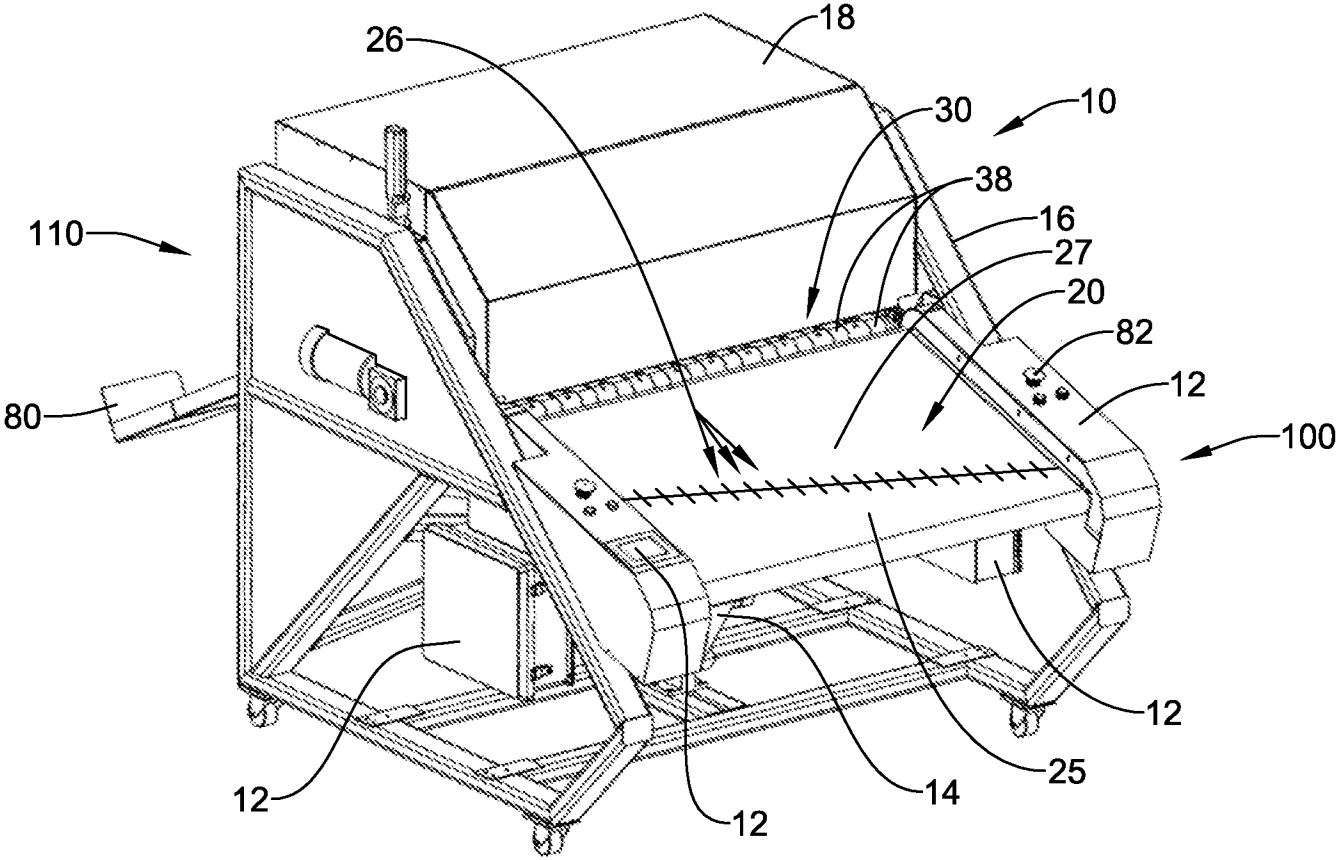
FIG. 1 is a front isometric view of an illustrative mat rolling machine.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may include numbers that are rounded to the nearest significant figure. The recitation of numerical ranges by endpoints includes all numbers within that range (e.g., 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following description should be read with reference to the drawings wherein like reference numerals indicate like elements throughout the several views. The drawings, which are not necessarily to scale, depict illustrative embodiments of the claimed invention.

FIG. 1 is a front isometric view showing certain externally visible components of an illustrative mat rolling machine 10. Some of the externally visible components may include a control panel 12, a frame 16 defining a front 100 and a rear 110 of the mat rolling machine 10, and a hood 18. The hood 18 may enclose certain elements of the mat rolling machine 10. At least one first drive belt 20 may extend from the front 100 of the mat rolling machine 10 rearward toward a plurality of second drive belts 30. The at least one first drive belt 20 may be disposed about a first set of at least two spaced-apart parallel first rollers 22, as can be seen more clearly in FIG. 5. A portion of the frame 16 supporting the at least one first drive belt 20 may be connected to a height adjustment means 14. The height adjustment means 14 may be actuated to raise and/or lower one of the first rollers 22 located proximate the front 100 of the mat rolling machine 10, so as to customize its height for a particular operator. The height adjustment means 14 may be actuated by pneumatic, hydraulic, electric, or other appropriate means. In some embodiments, the height adjustment means 14 may be a pneumatic cylinder and may be actuated to adjust the first roller 22 located proximate the front 100 of the mat rolling machine 10 between a lower vertical height and a higher vertical height. In some embodiments, the height adjustment means 14 may be actuated in response to input at the control panel 12.

The at least one first drive belt 20 may comprise a first set of at least two spaced-apart parallel rollers 22, at least one first endless belt 28 disposed about the first set of at least two spaced-apart parallel rollers 22, and a first drive means 24. The first drive means 24 may be operatively connected to one of the at least two spaced-apart parallel rollers 22. The first drive means 24 may be configured to rotate the at least one first endless belt 28 in a first direction via the one of the at least two spaced-apart parallel rollers 22. In the view shown in FIG. 5, for example, the first direction may be a counter-clockwise direction. The at least one first drive belt 20 provides a motive force that feeds a leading edge of a mat into the mat rolling machine 10 from the front 100. The at least one first endless belt 28 may be a wide single belt. A wide single belt may reduce the number of pinch points in the operating area of the machine compared to a plurality of narrow belts. The at least one first endless belt 28 may be made from a textured, gripping material such as a woven rubber or other suitable material.

Figure 4:
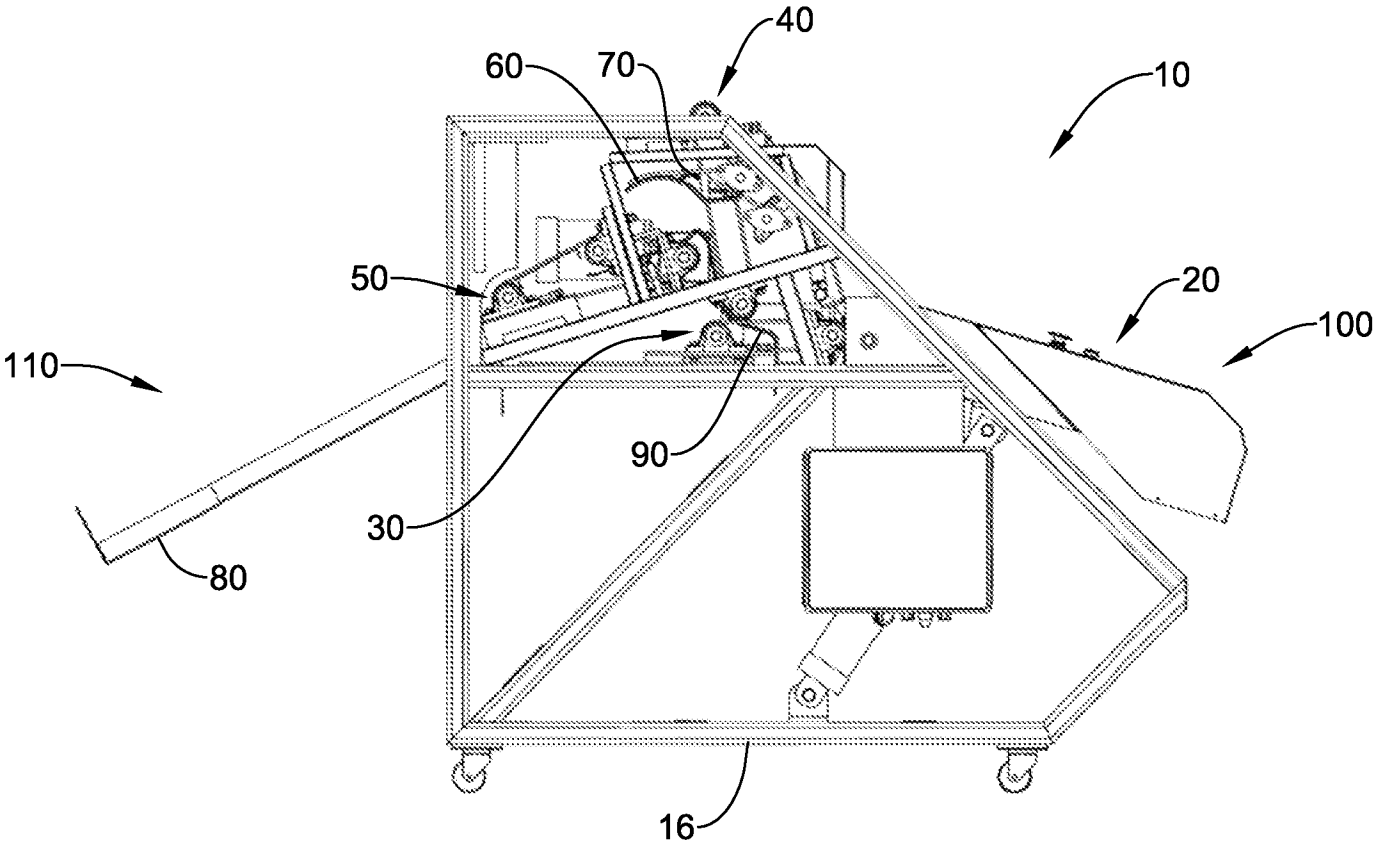
FIG. 4 is a side cross-sectional view of an illustrative mat rolling machine with certain components removed.
Figure 5:
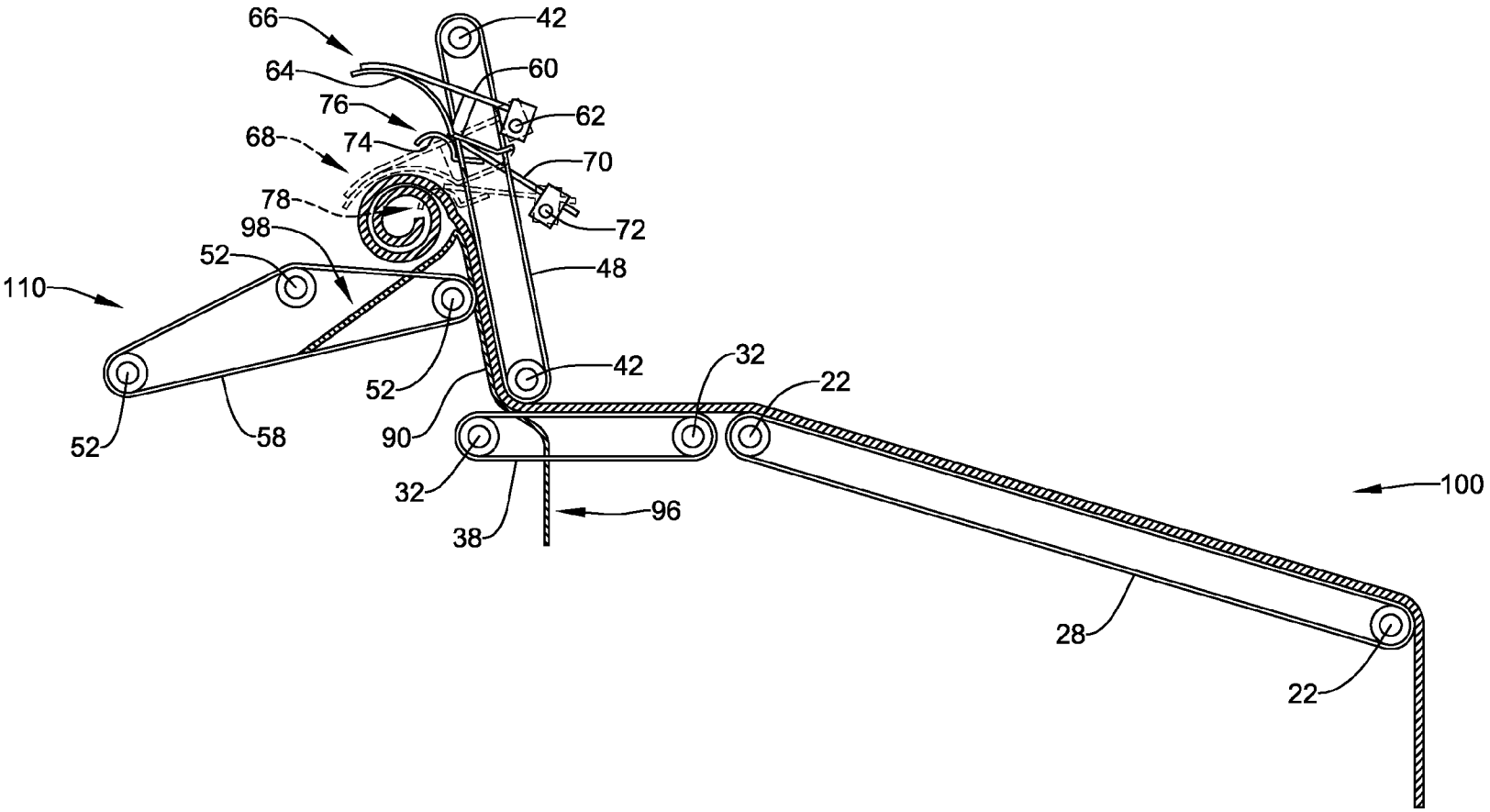
FIG. 5 is a partial side schematic view of an illustrative mat rolling machine showing a path of a mat through the mat rolling machine.

A plurality of second drive belts 30 may be disposed at least partially rearward of the at least one first drive belt 20, as seen in FIGS. 1, 2, 4, and 5. The plurality of second drive belts 30 may comprise a second set of at least two spaced-apart parallel second rollers 32, at least two second endless belts 38 disposed about the second set of at least two spaced-apart parallel rollers 32, and a second drive means 34. In some embodiments, the second rollers 32 may have a stepped or non-uniform outer surface, such that where the plurality of second endless belts 38 overlaps or is disposed about the second rollers 32, the second rollers 32 may have a reduced outer diameter to maintain the positioning and/or alignment of the plurality of second endless belts 38. In some embodiments, the plurality of second drive belts 30 may be oriented in a generally horizontal manner. In other embodiments, the plurality of second drive belts 30 may be oriented in an inclined or declined manner. The second drive means 34 may be operatively connected to one of the at least two spaced-apart parallel second rollers 32. The second drive means 34 may be configured to rotate the at least two second endless belts 38 in the first direction via one of the at least two spaced-apart parallel second rollers 32. In the view shown in FIG. 5, for example, the first direction may be a counter-clockwise direction. The plurality of second drive belts 30 provide a motive force that feeds the leading edge of a mat into the mat rolling machine 10 from the front 100 towards at least one support member 90 disposed between and laterally offset from adjacent second endless belts 38. As illustrated in FIG. 5, the mat follows a path through the mat rolling machine 10 from the front 100 toward the rear 110. The at least one support member 90 guides the mat upward from the plurality of second belts 30, alongside a plurality of third drive belts 40, to a position above a plurality of fourth drive belts 50. The at least two second endless belts 38 may be made from a textured, gripping material such as a woven rubber or other suitable material. In some embodiments, the at least two second endless belts 38 may be made from the same material as the at least one first endless belt 28. In some embodiments, the at least two second endless belts 38 may each be narrower in width than the at least one first endless belt 28.

Figure 2:
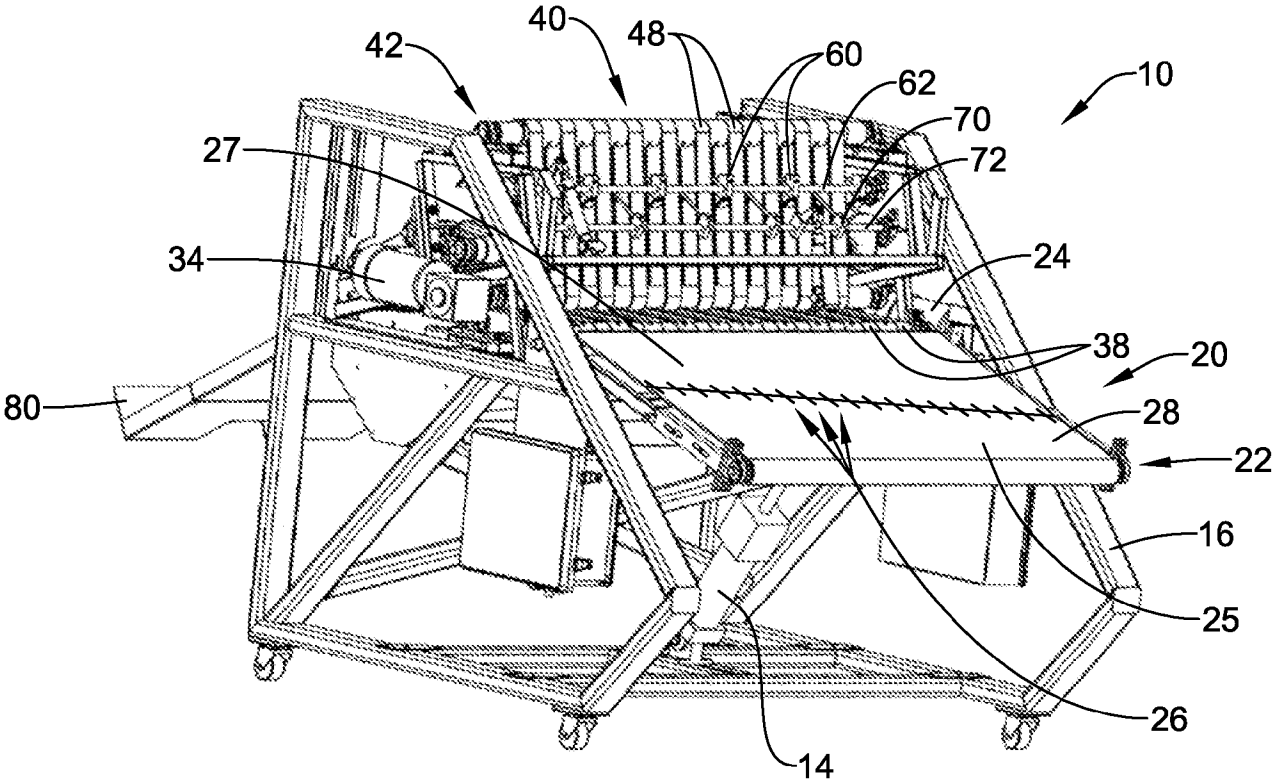
FIG. 2 is a front isometric view of an illustrative mat rolling machine with certain components removed.

A plurality of third drive belts 40 may be disposed above the plurality of second drive belts 30, as seen in FIGS. 2, 4, and 5. The plurality of third drive belts 40 may comprise a third set of at least two spaced-apart parallel third rollers 42, and at least two third endless belts 48 disposed about the third set of at least two spaced-apart parallel rollers 42. In some embodiments, the third rollers 42 may have a stepped or non-uniform outer surface, such that where the plurality of third endless belts 48 overlaps or is disposed about the third rollers 42, the third rollers 42 may have a reduced outer diameter to maintain the positioning and/or alignment of the plurality of third endless belts 48. The second drive means 34 may be operatively connected to one of the at least two spaced-apart parallel third rollers 42. The second drive means 34 may be configured to rotate the at least two third endless belts 48 in a second direction opposite the first direction via one of the at least two spaced-apart parallel third rollers 42. In the view shown in FIG. 5, for example, the second direction may be a clockwise direction. The plurality of third drive belts 40 may be inclined rearward at a non-zero angle relative to horizontal, as seen in FIGS. 4 and 5. In some embodiments, the plurality of third drive belts 40 may be oriented at an angle between 90 and 120 degrees, relative to horizontal. In some embodiments, the angle may be about 100 to about 110 degrees, about 105 degrees, or about 105.8 degrees, relative to horizontal. The at least two third endless belts 48 may be arranged such that at least a portion of each of the at least two third endless belts 48 is generally parallel to at least a portion of a forward-facing surface 96 of the at least one support member 90. As illustrated in FIG. 5, as the mat follows the path through the mat rolling machine 10 from the front 100 toward the rear 110, the mat passes between the plurality of second belts 30 and the plurality of third belts 40, and between the plurality of third belts 40 and the at least one support member 90. As the mat follows the path, the mat is effectively pinched between the plurality of second drive belts 30 and the plurality of third drive belts 40, and also between the plurality of third drive belts 40 and the at least one support member 90, such that the belts cooperate to carry or pull the mat through the mat rolling machine 10. The at least two third endless belts 48 may be made from a textured, gripping material such as a woven rubber or other suitable material. In some embodiments, the at least two third endless belts 48 may be made from the same material as the at least one first endless belt 28 and/or the at least two second endless belts 38. In some embodiments, the at least two third endless belts 48 may each be narrower in width than the at least one first endless belt 28, and may be narrower or wider in width than the at least two second endless belts 38.

Figure 3:
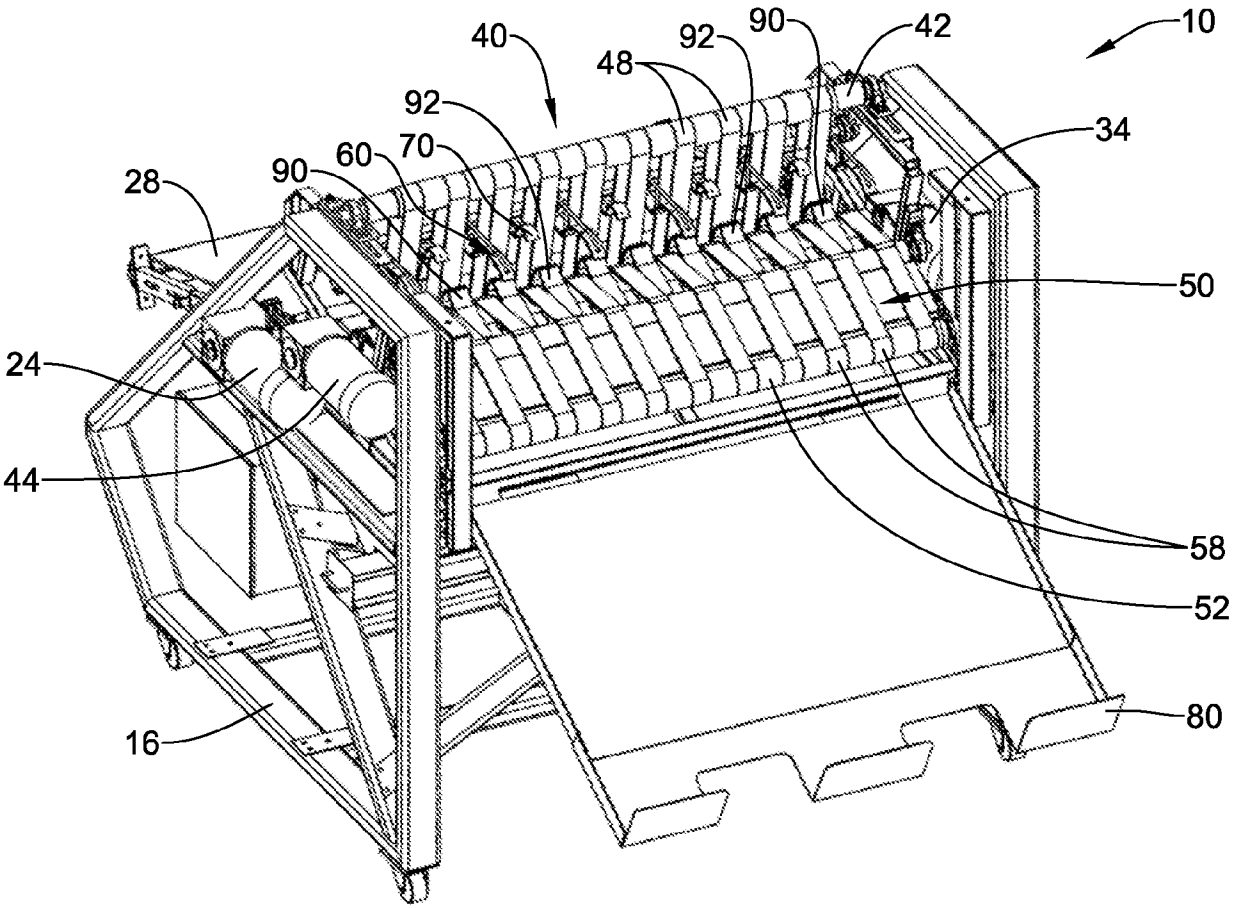
FIG. 3 is a rear isometric view of an illustrative mat rolling machine with certain components removed.

A plurality of fourth drive belts 50 may be disposed at least partially rearward of the plurality of third drive belts 40 and at least partially above the plurality of second drive belts 30, as seen in FIGS. 4 and 5. The plurality of fourth drive belts 50 may comprise a fourth set of at least two spaced-apart parallel fourth rollers 52, at least two fourth endless belts 58 disposed about the fourth set of at least two spaced-apart parallel fourth rollers 52, and a third drive means 44. In some embodiments, the fourth rollers 52 may have a stepped or non-uniform outer surface, such that where the plurality of fourth endless belts 58 overlaps or is disposed about the fourth rollers 52, the fourth rollers 52 may have a reduced outer diameter to maintain the positioning and/or alignment of the plurality of fourth endless belts 52. The third drive means 44 may be operatively connected to one of the at least two spaced-apart parallel fourth rollers 52. The third drive means 44 may be configured to rotate the at least two fourth endless belts 58 in the second direction opposite the first direction via one of the at least two spaced-apart parallel fourth rollers 52. In the view shown in FIG. 5, for example, the second direction may be a clockwise direction. The at least two fourth endless belts 58 may be made from a textured, gripping material such as a woven rubber or other suitable material. In some embodiments, the at least two fourth endless belts 58 may be made from the same material as the at least one first endless belt 28 and/or the at least two second and third endless belts 38/48. In some embodiments, the at least two fourth endless belts 58 may each be narrower in width than the at least one first endless belt 28, and may be similar in width to the at least two second endless belts 38. The at least one support member 90 may be disposed between and laterally offset from adjacent fourth endless belts 58, and may include a generally rearward- and upward-facing surface, as seen in FIGS. 3 and 5. In some embodiments, an upper surface of the plurality of fourth drive belts 50 may be oriented to incline slightly in a rearward direction at a non-zero angle relative to horizontal. In some embodiments, the upper surface of the plurality of fourth drive belts 50 may be oriented to incline between 0 and 20 degrees, about 3 to about 10 degrees, about 5 degrees, or about 5.3 degrees, relative to horizontal.

The positional relationship of the at least one first drive belt 20, the plurality of second drive belts 30, the plurality of third drive belts 40, and the plurality of fourth drive belts 50 is such that none of the parallel rollers 22, 32, 42, 52 are shared among different pluralities of drive belts. Each plurality of drive belts is independent from another plurality of drive belts. That is, the parallel rollers 32 support only the plurality of second drive belts 30, the parallel rollers 42 support only the plurality of third drive belts 40, and so on. In other words, the belt surfaces, when viewed from the side (such as in FIG. 5), do not intersect with each other, or the belts are not interleaved. This relationship permits the mat to pass through the mat rolling machine 10 from the front 100 to the rear 110 along the path of travel described herein. As the mat travels along the path through the mat rolling machine 10, the mat contacts each of the at least one first drive belt 20, the plurality of second drive belts 30, the plurality of third drive belts 40, and the plurality of fourth drive belts 50 in succession.

In some embodiments, a generally forward-facing surface 96 of the at least one support member 90 may extend from below the plurality of second drive belts 30, to an upper tip at a position above the plurality of fourth drive belts 50, where the at least one support member 90 may transition to a generally rearward- and upward-facing surface 98 that extends to below an upper surface of the plurality of fourth drive belts 50. The upper tip of the at least one support member 90 may be disposed about one-quarter inch, about one-half inch, about 1 inch, about 2 inches, about 3 inches, or more vertically above the forwardmost fourth roller 52. At least a portion of the rearward- and upward-facing surface 98 of the at least one support member 90 may be arranged at an angle of about 30 to about 60 degrees, about 40 to about 50 degrees, or about 45 degrees relative to horizontal, at a position where the at least one support member 90 intersects the plurality of fourth drive belts 50 when viewed from the side, for example as seen in FIG. 5. The at least one support member 90 may be positioned between and laterally offset from adjacent second endless belts 38 and may be positioned between and laterally offset from adjacent fourth endless belts 58. The at least one support member 90 helps to guide the leading edge of the mat along the path through the mat rolling machine 10 from front 100 to rear 110. The at least one support member 90 may be made to have a relatively smooth surface, and may be made from metal, plastic, or another suitable material that does not create undue friction or heat as the mat is moved along the surface of the at least one support member 90.

In some embodiments, the mat rolling machine 10 may further comprise at least one generally rearward- and upward-facing pusher 92 adapted to discharge the mat from the rear 110 of the mat rolling machine 10 in the generally spiral configuration. The generally rearward- and upward-facing pusher 92 may be disposed between and laterally offset from adjacent fourth endless belts 58. In some embodiments, the at least one pusher 92 may form a portion of the at least one support member 90. In other embodiments, the at least one pusher 92 may be an element separate from the at least one support member 90. The at least one pusher 92 may be actuated by at least one pneumatic cylinder, hydraulic cylinder, electric actuator, or other suitable means. In some embodiments, the at least one pusher 92 may be activated manually, or the at least one pusher 92 may be activated automatically in response to a particular sensor input or a time delay from another function, action, or sensor input of the mat rolling machine 10.

The mat rolling machine 10 may include a plurality of primary fingers 60 configured to be moveable as a set between a first raised position 66 and a first lowered position 68. Each of the plurality of primary fingers 60 may be oriented generally rearward and has a first radius of curvature on a generally concave lower face 64. The plurality of primary fingers 60 may be attached to a first rod 62, which can pivot to actuate the plurality of primary fingers 60 between the first raised position 66 and the first lowered position 68 (shown in phantom), as seen in FIG. 5. The plurality of primary fingers 60 may be made to have a relatively smooth surface and may be made from metal, plastic, or another suitable material that does not create undue friction as the mat is moved along the surface of the plurality of primary fingers 60.

The mat rolling machine 10 may further include a plurality of secondary fingers 70 configured to be moveable as a set between a second raised position 76 and a second lowered position 78. Each of the plurality of secondary fingers 70 may be oriented generally rearward and has a second radius of curvature on a generally concave lower face 74 that is smaller than the first radius of curvature on the generally concave lower face 64 of the plurality of primary fingers 60, as seen in FIGS. 3-5. The plurality of secondary fingers 70 may be attached to a second rod 72, which can pivot to actuate the plurality of secondary fingers 70 between the second raised position 76 and the second lowered position 78 (shown in phantom), as seen in FIG. 5. In some embodiments, the second lowered position 78 is lower than the first lowered position 68, such that in use, the mat will contact the plurality of secondary fingers 70 before the mat contacts the plurality of primary fingers 60. The plurality of secondary fingers 70 may be made to have a relatively smooth surface and may be made from metal, plastic, or another suitable material that does not create undue friction as the mat is moved along the surface of the plurality of secondary fingers 70.

In some embodiments, a first sensor (not shown) may be provided at the rearward end of the at least one first drive belt 20 to sense when the leading and/or trailing edge of the mat has moved past the rearward end of the at least one first drive belt 20. The sensor may be a photo-detector, an opto-electronic sensor, or other suitable sensor. In some embodiments, the sensor may include a light transmitter (not shown) and receiver or reflector. In some embodiments, the at least one first drive belt 20 may be automatically stopped at a predetermined period of time after the trailing edge of the mat has traveled along the path past the at least one first drive belt 20.

In some embodiments, a second sensor (not shown) may also, or alternatively, be provided within the hood 18 such that the sensor can detect when the leading and/or trailing edge of the mat has moved past a point between the plurality of second drive belts 30 and the plurality of fourth drive belts 50. The sensor may be a photo-detector, an opto-electronic sensor, or other suitable sensor. In some embodiments, the sensor may include a light transmitter (not shown) and receiver or reflector. Such a sensor, if provided, may be positioned to point between the at least two third endless belts 48, and a reflector, if provided, may be positioned under the plurality of fourth drive belts 50 and rearward of the at least one support member 90. In some embodiments, the sensor feedback may be used to actuate the plurality of primary fingers 60 and/or the plurality of secondary finger 70 from their respective raised positions 66, 76 to their respective lowered positions 68, 78. In some embodiments, when the sensor detects the trailing edge of the mat, a timer will be initiated to shut down the mat rolling machine 10, thereby ending the mat rolling cycle.

In some embodiments, a third sensor (not shown) may be provided within the hood 18 to detect the presence or absence of a rolled mat on the upper surface of the plurality of fourth drive belts 50. The sensor may be a photo-detector, an opto-electronic sensor, or other suitable sensor. In some embodiments, the sensor may include a light transmitter (not shown) and receiver or reflector. A reflector for such a sensor, if provided, may be disposed, for example, on the at least one pusher 92 or at a suitable position between the at least two fourth endless belts 58. A sensor detecting the presence or absence a rolled mat on the upper surface of the plurality of fourth drive belts 50 may be used to initiate or delay the start of a new mat rolling cycle. If a rolled mat is present, the at least one first drive belt 20 may not be permitted to re-start to initiate a new mat rolling cycle. If a rolled mat is absent, the at least one first drive belt 20 may be permitted to start, thereby initiating a new mat rolling cycle.

One of ordinary skill in the art will appreciate that the above-described sensors, where present, may be moved, repositioned, or modified to accommodate a desired operation of the mat rolling machine 10.

In some embodiments, the first or second sensor, where provided, may communicate with the control panel 12 to actuate the plurality of primary fingers 60 from the first raised position 66 to the first lowered position 68 as the leading edge of the mat is detected. The plurality of secondary fingers 70 may be actuated from the second raised position 76 to the second lowered position 78 in response to the same or a different sensor input, or in response to a time delay from the sensor input that activates the plurality of primary fingers 60. Alternatively, the plurality of primary fingers 60 and the plurality of secondary fingers 70 may be actuated to the first lowered position 68 and the second lowered position 78, respectively, upon initial activation of the mat rolling machine 10, simultaneously, independently, or as otherwise provided herein.

In use, the plurality of secondary fingers 70 may remain in the second lowered position 78 for a brief period of time, which may be as little as a fraction of a second to a few seconds in length, or about 0.1 second to 10 seconds or more. The period of time may be predetermined, or may be determined by sensor feedback obtained during operation of the mat rolling machine 10. The plurality of secondary fingers 70, in the second lowered position 78, contacts the leading edge of the mat and cooperates with the plurality of fourth drive belts 50 to initiate a roll into a generally spiral configuration. The leading edge of the mat is tightly curved around to rest on a following portion of the mat. After the roll has been initiated, or after the passage of a predetermined period of time, the plurality of secondary fingers 70 is actuated to the second raised position 76. The remainder of the mat is rolled into the generally spiral configuration through the cooperation of the plurality of primary fingers 60 and the plurality of fourth drive belts 50. The plurality of fourth drive belts 50 carry the following portion of the mat in a forward direction, where the mat is guided upward by the rearward- and upward-facing surface of the at least one support member 90 and into contact with the generally concave lower face 64 of the plurality of primary fingers 60. With each successive coil or roll of the mat, the outer diameter of the generally spiral configuration increases.

The general path of the mat through the mat rolling machine 10 and the generally spiral configuration formed may be seen in FIG. 5. In some embodiments, the path of travel moves the mat along an upper surface of the at least one first drive belt 20 and an upper surface of the plurality of second drive belts 30, upward from the upper surface of the plurality of second drive belts 30 between at least one support member 90 and a generally rearward-facing surface of the plurality of third drive belts 40 to a position above the plurality of fourth drive belts 50. At a position above the plurality of fourth drive belts 50, the mat may contact the plurality of primary fingers 60 and/or the plurality of secondary fingers 70, which will guide the mat downward toward the plurality of fourth drive belts 50 and into the generally spiral configuration.

It will be appreciated that the exact timing and/or order of the actuation of the plurality of primary fingers 60 and the plurality of secondary fingers 70 may be modified as needed to obtain the desired generally spiral configuration. In some embodiments, the generally spiral configuration may include a hollow interior having a diameter of about 1 inch up to about 2 inches, 3 inches, 4 inches, 5 inches, or more. In some embodiments, the plurality of primary fingers 60 and the plurality of secondary fingers 70 may be actuated to their respective lowered positions at the same time.

Figure 6:
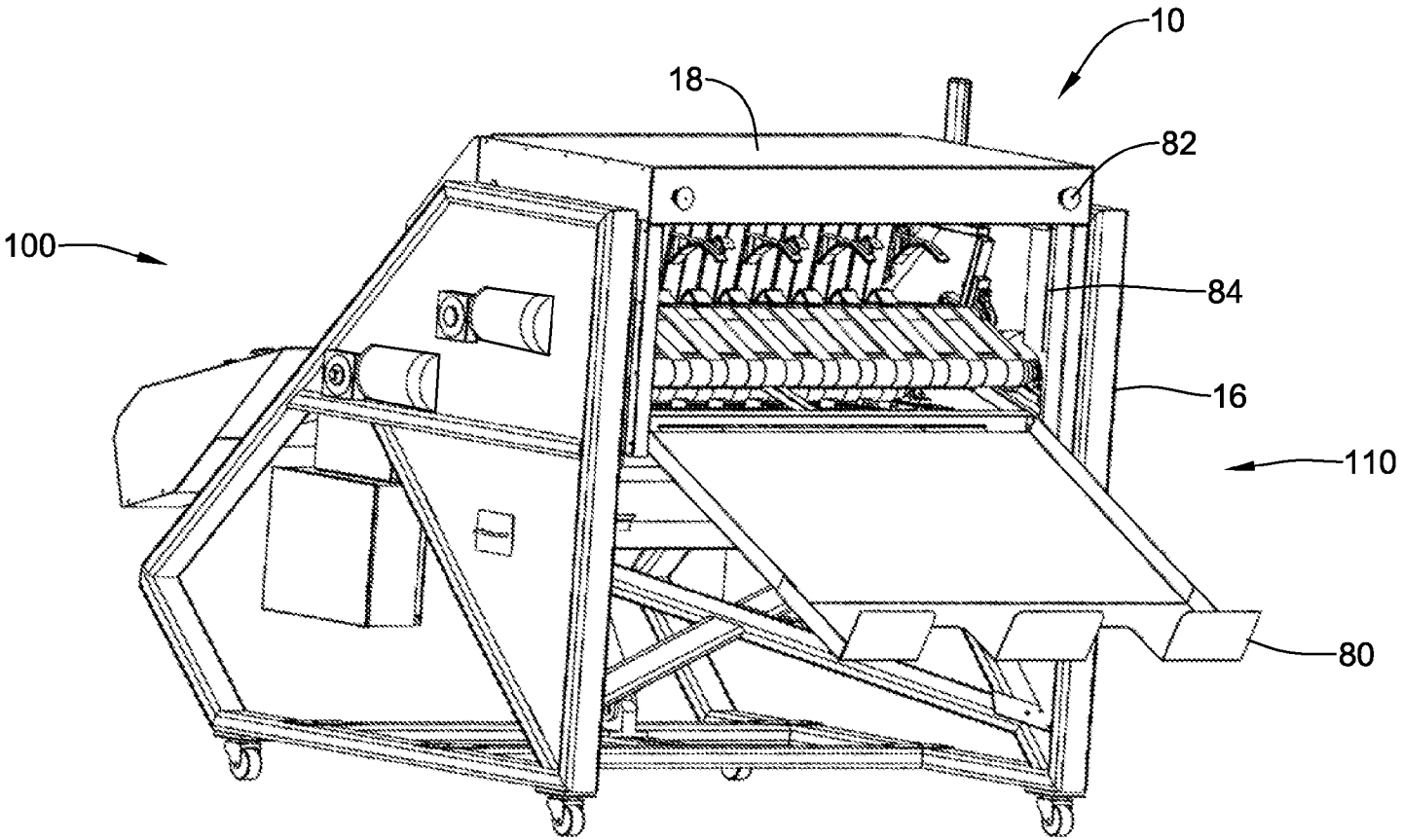
FIG. 6 is a rear isometric view of an illustrative mat rolling machine.

As seen in FIG. 6, the hood 18 may also include a light curtain 84 or similar safety device, for example, at the rear 110 of the mat rolling machine 10 to sense incursion into the rear of the hood 18. When an incursion is sensed, the controls automatically shut down the mat rolling machine 10. Other safety devices and/or features, such as emergency stop buttons 82, may be provided on the hood 18, the control panel 12, or other suitable locations on the mat rolling machine 10, as seen in FIGS. 1 and 6.

A foot pedal (not shown) may be provided to activate, cycle, and/or stop the mat rolling machine 10. The foot pedal may connect to the control panel 12. Depressing the foot pedal may activate the mat rolling machine 10. In some embodiments, the foot pedal may need to remain depressed throughout the entire machine cycle, and releasing the foot pedal may immediately stop the mat rolling machine. In other embodiments, the foot pedal may be released immediately upon activation of the mat rolling machine 10. In other embodiments, a second depression of the foot pedal may deactivate or stop the mat rolling machine 10.

In some embodiments, the mat rolling machine 10 may be configured to operate in a manual mode or an automatic mode. In the manual mode, the mat rolling machine 10 may function in a single-cycle operation, where each mat rolling cycle is initiated by input at the foot pedal or the control panel 12. Following each mat rolling cycle, the mat rolling machine 10 remains shut down until a new mat rolling cycle is manually initiated. In the automatic mode, the mat rolling machine 10 may utilize a pre-programmed cycle within the control panel 12 to automatically start a new mat rolling cycle once a rolled mat has been discharged from the rear 110 of the mat rolling machine 10. In the automatic mode, the at least one first drive belt 20 may be stopped once the trailing edge of the mat has moved past the at least one first drive belt 20 so that a new mat may be loaded into position for the next mat rolling cycle. At the new mat is being loaded into position on the at least one first drive belt 20, the plurality of second, third, and fourth drive belts 30, 40, and 50, continue operating to roll the mat into the generally spiral configuration. After the plurality of second, third, and fourth drive belts 30, 40, and 50 have stopped, and the at least one pusher 92 has discharged the rolled mat from the rear 110 of the mat rolling machine 10, a new mat rolling cycle may be automatically initiated.

At the rear 110 of the mat rolling machine 10, there may be a moveable shelf or accumulator mechanism 80. Moveable shelf or accumulator mechanism 80 may retain a predetermined quantity of rolled mats, after the rolled mats have been discharged from the rear 110 of the mat rolling machine 10, until the rolled mats can be removed. In some embodiments, the mat rolling machine 10 may be provided with a bin container or a conveyor system at the rear 110 of the mat rolling machine 10 for removal and/or storage of the rolled mats.

A method of rolling a mat may include obtaining a mat rolling machine 10, such as that described above. A mat may be disposed on the at least one first drive belt 20. The at least one first drive belt 20 may be activated by depressing the foot pedal. The plurality of second drive belts 30, the plurality of third drive belts 40, and the plurality of fourth drive belts 50 may be activated concurrently with the at least one first drive belt 20 (via the foot pedal), or may be activated after a predetermined time delay or in response to a sensor input indicating the leading edge of the mat has reached the rear end of the at least one first drive belt 20. The plurality of primary fingers 60 may be actuated into a first lowered mat-rolling position 68. The mat may be fed into the machine along a path of travel. The plurality of secondary fingers 70 may be actuated into a second lowered mat-rolling position 78 to contact the mat and cooperate with the plurality of fourth drive belts 50 to initiate a roll into a generally spiral configuration.

After initiating the roll, the plurality of secondary fingers 70 may be actuated into a second raised position 76 out of contact with the mat, such that the plurality of primary fingers 60 in the first lowered mat-rolling position 68 and the plurality of fourth drive belts 50 maintain the roll and form the mat into the generally spiral configuration as the mat is fed through the mat rolling machine 10 along the path of travel. The plurality of primary fingers 60 may be actuated into a first raised position 66 out of contact with the mat. The at least one first drive belt 20 may be stopped. The plurality of second drive belts 30, the plurality of third drive belts 40, and the plurality of fourth drive belts 50 may be stopped concurrently with, or independently of, the at least one first drive belt 20. After the plurality of fourth drive belts 50 has been stopped, at least one pusher 92 may be actuated to discharge the mat from the rear 110 of the mat rolling machine 10 in the generally spiral configuration. After discharging the mat from the rear 110 of the mat rolling machine 10, the at least one pusher 92 may be automatically or manually actuated back to its original position.

FIGS. 7-9B illustrate an example drive belt for use with the mat rolling machine described above. In the figures, the drive belt is identified as first endless belt 28. However, other endless belts of the mat rolling machine 10 may be constructed and/or used in the same or similar manner as first endless belt 28—for example, second endless belts 38, third endless belts 48, and/or fourth endless belts 58.

Figure 7:
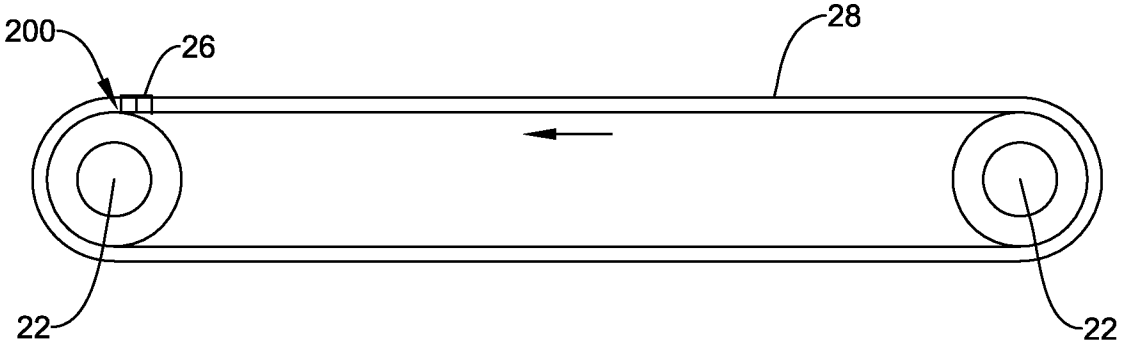
FIG. 7 is a side view of a drive belt of an illustrative mat rolling machine.

FIG. 7 illustrates a side view of first endless belt 28 disposed about the first set of at least two spaced-apart parallel rollers 22. As shown in FIG. 7, the first endless belt 28 may rotate about the first set of at least two spaced-apart parallel rollers 22 in a counter-clockwise direction (as viewed from the left side). First endless belt 28 may include a first end 25 and an opposing second end 27 adjacent to the first end 25, as seen in FIGS. 1 and 2. First end 25 and second end 27 may be connected, joined, secured, fastened, or otherwise held in proximity to each other by a plurality of belt fastening means 26. As can be seen from FIG. 7, as first endless belt 28 rotates about the at least two spaced-apart parallel rollers 22, each of the plurality of belt fastening means 26 will contact an outer surface of a roller 22 at a contact or impact point 200. When the belt fastening means 26 makes contact with the roller 22 at impact point 200, an audible impact noise or sound is produced. The audible impact noise or sound may be distracting for an operator of the mat rolling machine 10. The audible impact noise may also damage the hearing of an operator if the intensity of the impact noise reaches a certain level or threshold. The more belt fastening means 26 that impact roller 22 at a single point in time, the louder (and/or more intense) the audible impact noise will be.

Figure 9A:
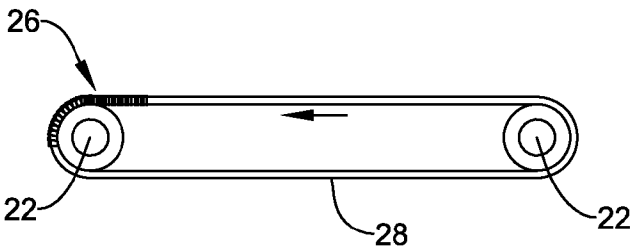
FIG. 9A is a side view of a drive belt of an illustrative mat rolling machine.
Figure 9B:
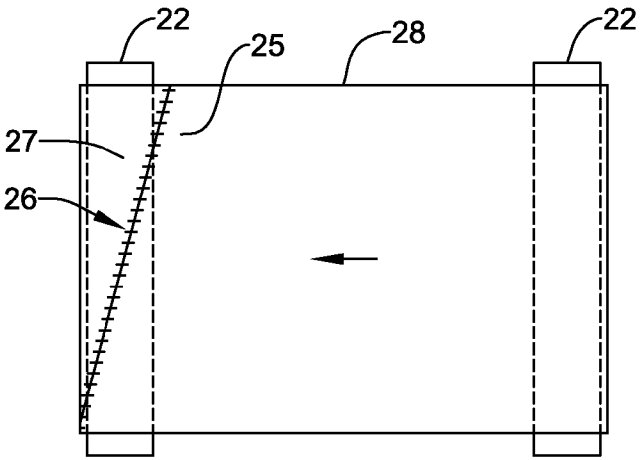
FIG. 9B is a top view of a drive belt of an illustrative mat rolling machine.
Figure 8A:
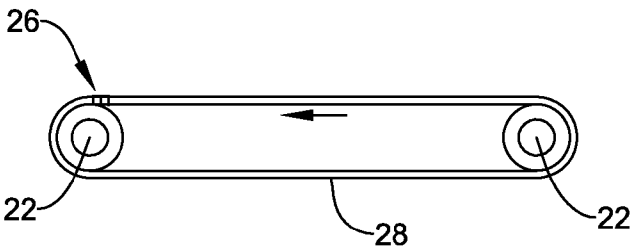
FIG. 8A is a side view of a drive belt of an illustrative mat rolling machine.
Figure 8B:
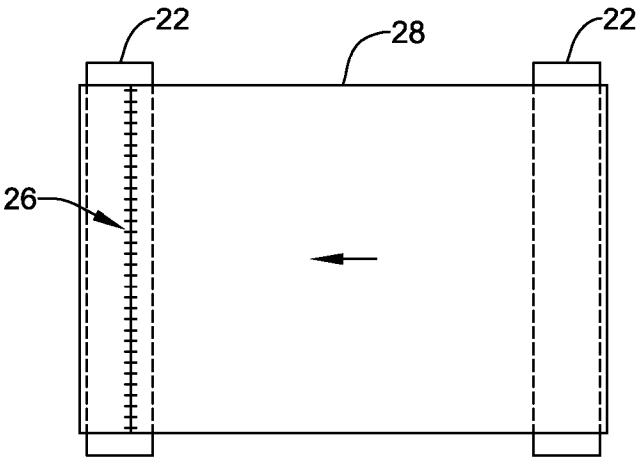
FIG. 8B is a top view of a drive belt of an illustrative mat rolling machine.

In some embodiments, such as may be seen in FIGS. 8A and 8B, the first end 25 and the second end 27 may be cut and/or fastened together at a relatively perpendicular orientation relative to the direction of travel of the belt. When the first end 25 and the second end 27 are arranged in this manner, all of the plurality of belt fastening means 26 may impact the roller 22 at the same point in time, thereby producing the loudest possible impact noise. In some embodiments, the first end 25 and the second end 27 may be cut and/or fastened together at an oblique angle relative to the direction of travel of the belt, as shown in FIGS. 9A and 9B. The angle may be between about 0 and about 60 degrees relative to horizontal, or relative to the roller(s) 22. For example, the angle may be about 2 degrees, about 5 degrees, about 10 degrees, about 20 degrees, about 30 degrees, about 45 degrees, or another suitable angle relative to horizontal, or relative to roller(s) 22. In some embodiments, the angle may be oriented distally to the left. In other words, relative to proximalmost roller 22 (nearest the front 100 of mat rolling machine 10), a distal edge of the first end 25 may be spaced distally farther from the proximalmost roller 22 along a left edge of the first endless belt 28 (i.e. where the distal edge intersects the left edge of the belt) than along a right edge of the first endless belt 28 (i.e. where the distal edge intersects the right edge of the belt), when the distal edge is disposed on or along an upwardly-facing surface of the first endless belt 28 (i.e. when the distal edge is visible from the top and/or front of the machine). When the first end 25 and the second end 27 are arranged at an angle, the number of belt fastening means 26 that impact the roller 22 at the same point in time may be reduced or limited, thereby reducing the impact noise generated by the belt fastening means 26 striking the roller 22 commensurately. In some embodiments, only one belt fastening means 26 may impact the roller 22 at a single point in time. In some embodiments, a plurality of belt fastening means 26 greater than one and less than all of the belt fastening means 26 may impact the roller 22 at a single point in time, such as for example, if the first end 25 and the second end 27 are arranged in a stepped fashion (not shown) or if the angle is sufficiently shallow to permit more than one belt fastening means 26 to impact roller 22 at the same time.

Figure 10A:
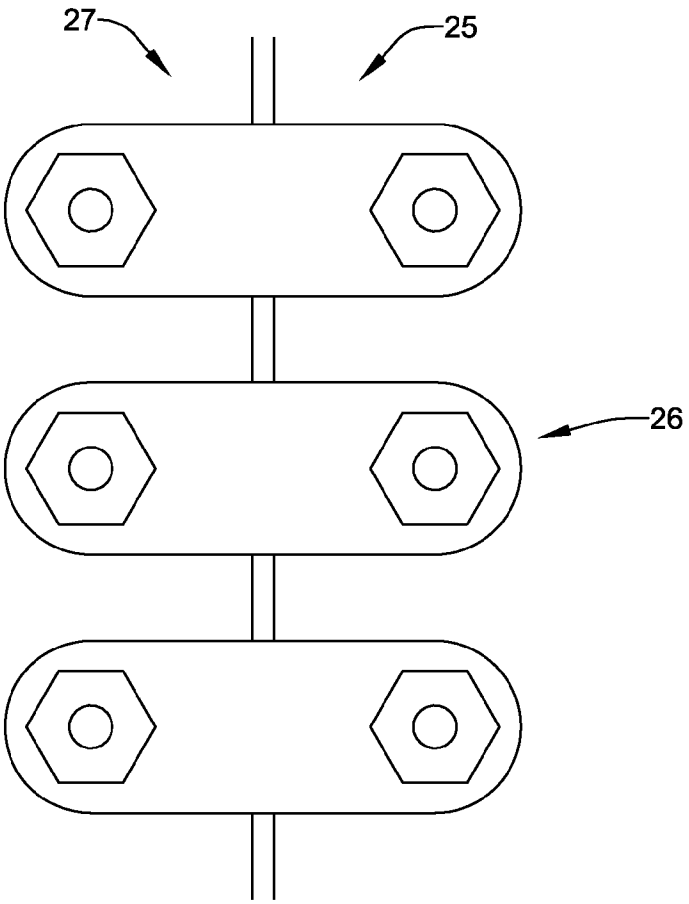
FIGS. 10A and 10B are illustrative top views of example belt fastening means.
Figure 10B:
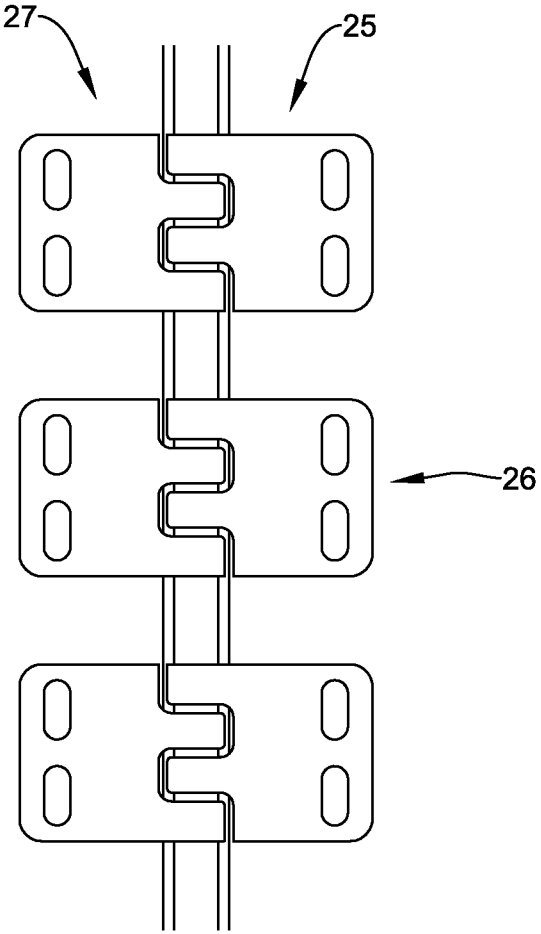
Figure 10C:
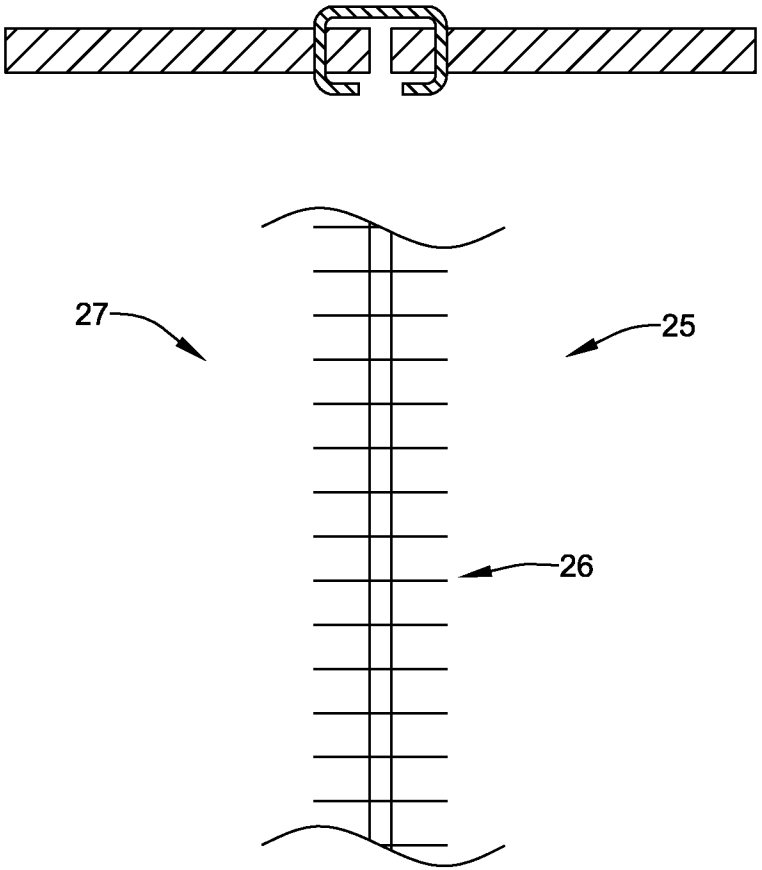
FIG. 10C shows illustrative top and side views of an example belt fastening means.

In some embodiments, belt fastening means 26 may include a bridge element attached to each of the first end 25 and the second end 27 with a screw, a bolt, or other mechanical fastener, and the like, such as that shown in FIG. 10A. The bridge element may be flexible, rigid, or some combination thereof, and the bridge element may be metallic, non-metallic, composite, or some combination thereof. In some embodiments, belt fastening means 26 may include a hinge element attached to each of the first end 25 and the second end 27 and joined together using a pin, a rod, a dowel, or a similar element (or a plurality thereof) to form a pivoting joint, such as that shown in FIG. 10B. The hinge elements may be metallic, non-metallic, composite, or some combination thereof. In some embodiments, belt fastening means 26 may include a staple element configured to pierce or pass through each of the first end 25 and the second end 27, such as that shown in FIG. 10C. The staple element may be metallic, non-metallic, composite, or some combination thereof. The staple element may couple the first end 25 and the second end 27 without the use or benefit of separate or additional fasteners or hardware.

It should be understood that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

What is claimed is:

1. A mat rolling machine for use in rolling a mat having a leading edge and a trailing edge, comprising:

a frame defining a front of the machine and a rear of the machine;

at least one first drive belt;

a plurality of second drive belts disposed at least partially rearward of the at least one first belt;

a plurality of third drive belts disposed above the plurality of second belts;

a plurality of fourth drive belts disposed at least partially rearward of the plurality of third belts and at least partially above the plurality of second belts;

a plurality of primary fingers configured to be movable as a set, wherein each primary finger is oriented generally rearward and has a first radius of curvature on a lower face; and a plurality of secondary fingers configured to be movable as a set, wherein each secondary finger is oriented generally rearward and has a second radius of curvature on a lower face smaller than the first radius of curvature;

wherein at least one of the at least one first drive belt, the plurality of second drive belts, the plurality of third drive belts, and the plurality of fourth drive belts includes a first end and an opposing second end, the first end and the second end coupled together at an oblique angle relative to a direction of travel of the at least one belt.

2. The mat rolling machine of claim 1, wherein the at least one first drive belt comprises:

a first set of at least two spaced-apart parallel first rollers;

at least one first endless belt disposed about the first set of spaced-apart parallel first rollers; and a first drive means operatively connected to one of the first rollers;

wherein the first drive means is configured to rotate the at least one first endless belt in a first direction.

3. The mat rolling machine of claim 2, wherein the plurality of second drive belts comprises:

a second set of at least two spaced-apart parallel second rollers;

at least two second endless belts disposed about the second set of spaced-apart parallel second rollers; and a second drive means operatively connected to one of the second rollers;

wherein the second drive means is configured to rotate the at least two second endless belts in the first direction.

4. The mat rolling machine of claim 3, wherein the plurality of third drive belts comprises:

a third set of at least two spaced-apart parallel third rollers; and at least two third endless belts disposed about the third set of spaced-apart parallel third rollers;

wherein the second drive means is operatively connected to one of the third rollers;

wherein the second drive means is configured to rotate the at least two third endless belts in a second direction opposite the first direction.

5. The mat rolling machine of claim 4, wherein the plurality of fourth drive belts comprises:

a fourth set of at least two spaced-apart parallel fourth rollers;

at least two fourth endless belts disposed about the fourth set of spaced-apart parallel rollers; and a third drive means operatively connected to one of the fourth rollers;

wherein the third drive means is configured to rotate the at least two fourth endless belts in the second direction.

6. The mat rolling machine of claim 2, wherein one of the spaced-apart parallel first rollers is disposed proximate the front of the mat rolling machine and is adjustable between a lower and a higher vertical height.

7. The mat rolling machine of claim 1, further comprising at least one support member disposed between and offset laterally from adjacent second drive belts.

8. The mat rolling machine of claim 7, where the at least one support member is disposed between and offset laterally from adjacent fourth drive belts.

9. The mat rolling machine of claim 7, wherein an uppermost tip of the at least one support member is disposed about 1 inch vertically above the plurality of fourth drive belts.

10. The mat rolling machine of claim 7, wherein at least a portion of a generally rearward- and upward-facing surface of the at least one support member may be arranged at an angle of about 45 degrees relative to horizontal.

11. The mat rolling machine of claim 1, further comprising at least one generally rearward- and upward-facing pusher adapted to discharge the mat from the rear of the machine in the generally spiral configuration.

12. The mat rolling machine of claim 11, wherein the at least one generally rearward- and upward-facing pusher is disposed between and offset laterally from adjacent fourth drive belts.

13. The mat rolling machine of claim 1, wherein the mat follows a path through the mat rolling machine upward from the plurality of second drive belts to a position above the plurality of fourth drive belts prior to rolling the mat into a generally spiral configuration.

14. The mat rolling machine of claim 13, wherein the mat traveling along the path contacts the plurality of secondary fingers before the mat contacts the plurality of primary fingers.

15. The mat rolling machine of claim 14, wherein mat is in contact with the lower face of the plurality of secondary fingers for a shorter period of time than the mat is in contact with the lower face of the plurality of primary fingers as the mat is rolled into the generally spiral configuration.

16. The mat rolling machine of claim 1, wherein the plurality of third drive belts is inclined rearward at a non-zero angle relative to horizontal.

17. The mat rolling machine of claim 16, wherein the non-zero angle relative to horizontal is from about 100 degrees to about 110 degrees.

18. The mat rolling machine of claim 1, wherein an upper surface of the plurality of fourth drive belts is inclined rearward at a non-zero angle relative to horizontal.

19. The mat rolling machine of claim 18, wherein the non-zero angle relative to horizontal is about 5 degrees.

20. The mat rolling machine of claim 1, wherein the oblique angle is between about 2 degrees and about 30 degrees.

21. The mat rolling machine of claim 20, wherein the oblique angle is about 5 degrees.

22. The mat rolling machine of claim 1, wherein a distal edge of the first end is spaced distally farther from the front of the machine where the distal edge intersects a left edge of the at least one belt than where the distal edge intersects a right edge of the at least one belt, when the distal edge is disposed along an upwardly-facing surface of the at least one belt.

23. The mat rolling machine of claim 1, wherein the at least one belt further includes a plurality of belt fastening means coupling the first end to the second end.

24. The mat rolling machine of claim 23, wherein the plurality of belt fastening means is arranged such that less than all of the belt fastening means impact a supporting roller at a single point in time.

25. The mat rolling machine of claim 24, wherein the plurality of belt fastening means is arranged such that only one of the belt fastening means impact the supporting roller at the single point in time.

* * * * *